United States Patent [19]

Hobgood

[11] Patent Number: 4,635,418

[45] Date of Patent: Jan. 13, 1987

[54] PORTABLE PARTITION WALL SYSTEM

[76] Inventor: Charles M. Hobgood, P.O. Box 19916, Atlanta, Ga. 30343

[21] Appl. No.: 677,227

[22] Filed: Dec. 3, 1984

[51] Int. Cl.[4] ..... E04H 1/00

[52] U.S. Cl. ..... 52/239; 52/586; 52/DIG. 13; 160/135

[58] Field of Search ..... 52/239, DIG. 13, 586, 52/309.9, 222; 160/135, 351, 352

[56] References Cited

U.S. PATENT DOCUMENTS

| | | | |
|---|---|---|---|
| 3,113,401 | 12/1963 | Rose | 52/586 X |
| 3,571,999 | 3/1971 | Downing | 160/135 X |
| 3,889,736 | 6/1975 | Fieks | 160/351 X |
| 4,020,604 | 5/1977 | Legler et al. | 160/351 X |
| 4,028,855 | 6/1977 | Prewer | 52/DIG. 13 |
| 4,047,337 | 9/1977 | Bergstrom | 160/135 X |
| 4,090,335 | 5/1978 | Curatolo | 52/DIG. 13 X |
| 4,118,903 | 10/1978 | Coulthard | 52/DIG. 13 X |
| 4,121,645 | 10/1978 | Behr | 160/135 |
| 4,134,564 | 1/1979 | Hanna | 160/351 X |
| 4,194,313 | 3/1980 | Downing | 160/135 X |
| 4,250,676 | 2/1981 | Presby | 52/222 |
| 4,263,761 | 4/1981 | Kristoff | 160/351 X |
| 4,275,520 | 6/1981 | Appleton et al. | 52/DIG. 13 X |
| 4,398,376 | 8/1983 | Fraioli | 52/222 X |
| 4,491,166 | 1/1985 | Hanna | 52/586 X |

OTHER PUBLICATIONS

Portable Class Lightweight Displays; Brochure by Channel-Kor Systems, Inc.; ©1984.

The Escort Display Corp.; Brochure; undated.

Flexigraph; Brochure; undated.

Channel-Kor Systems, Inc.; Brochure by Southco Graphics Systems, Inc.; ©1981.

Downing Displays, Inc.; Brochure; Feb. 1985.

Featherlite Express; Brochure by American Display Company; undated.

Haworth; Advertisement in Skyline magazine; Feb. 1985.

Specdata, Specifications for STYROFOAM TM brand insulation; by Dow Chemical U.S.A.; May 1983.

Specifications for Velvet Loop Fabric; copied in part from specifications by Velcro USA, Inc.; undated.

Brochure entitled "The Heritage Line" by Heritage Communications; price sheet; Cover letter dated Jan. 13, 1986.

A copy of letter to Heritage Communications, dated Jan. 21, 1986.

Letter from Heritage Communications, Inc. dated Jul. 22, 1986 with four enclosures (four letters).

Letter from Heritage Communications dated Aug. 1, 1986 with enclosures (three drawings, forms re Atlanta Show, printing invoice, photograph and brochure).

*Primary Examiner*—Carl D. Friedman

*Assistant Examiner*—Creighton Smith

*Attorney, Agent, or Firm*—Jones & Askew

[57] ABSTRACT

A portable partition wall system which is lightweight, easy to maintain, requires no finishing trim, and can be assembled and disassembled without any tools. Wall panels consisting of a velcro loop fabric bonded to a polyester foam core are joined together by Velcro hook tape. The panel core has a central groove along its edges into which the Velcro loop fabric is inserted and glued to prevent premature separation of the fabric and core.

7 Claims, 16 Drawing Figures

PORTABLE PARTITION WALL SYSTEM

TECHNICAL FIELD

The present invention relates to a method and apparatus for manufacturing and utilizing partition wall panels, and more particularly relates to a method for manufacturing partition wall panels which require no tools for assembly and disassembly.

BACKGROUND ART

Present partition wall systems suffer from one or more disadvantages. Some systems, especially those fabricated from metal or plywood, have such weight that two or more persons are typically required to assemble, disassemble or transport elements of the system. Some wall systems offer only a limited selection of wall panel dimensions, which dimensions frequently do not match the given room or display area and result in an inefficient or undesired partition wall layout. Other wall systems require the use of tools for assembly, disassembly, or to obtain a tight fit, and therefore require that the person(s) assembling, disassembling, or maintaining the partition walls carry a variety of tools. Other wall systems have panels mounted on separate and the support posts, and therefore require a certain number of each element for assembly. Some wall systems, especially those having separate support posts, require finishing trim in order to eliminate rough and/or unsightly edges and/or unused holes. Still other wall systems, particularly some of those with a fabric surface, have feet which extend outward from the wall panels and, when bordering an aisle or other walkway, can cause persons to trip and be harmed. Fabric wall systems are typically covered with a fabric which has a tendency to absorb liquids and is permanently stained and discolored by accidental spilling of coffee, milk, soft drinks, other liquids and/or foods against the wall panels.

Most wall systems can only be assembled with a particular edge pointing upward and, if damaged, cannot be turned upside-down to conceal the damage. Some wall systems, especially those with separate support posts, can only change direction or terminate at a support post and thus require an inventory of essential, but generally specialized, small or intermediate-sized wall panels so that the direction can be changed or so that the partition wall terminates at or near a desired point. Some wall systems, especially those in which each panel is not physically connected to an adjacent panel, require the user to overlap panel walls, which wastes floor space, or to be content with a noticeable gap or space between adjacent panels. Other wall systems, particularly those covered with fabric and required to be joined to edge-to-edge, suffer from separation of the covering fabric from the underlying core after a limited number of assembly-disassembly cycles. Most partition wall systems, especially those with metal wall panels, are available only in a very limited number of sizes and colors and therefore cannot be customized to match with a user's desired decor.

SUMMARY OF THE INVENTION

Generally described, the present invention is a knock-down partition wall system comprised of a plurality of panels of which each has a pair of major surfaces connected by a continuous edge, the major surfaces and the edge being completely covered by a loop fabric, and a connecting means for releasably joining the panels, the connecting means comprising an elongate fastening hook tape which has fastening hooks on both sides of the tape.

Generally described, the present invention also provides a method of making a partition wall panel which has a durable fabric-core bond along the edge of the panel by circumscribing a groove into the continuous edge around the core panel, applying a bonding agent to one of the major surfaces of the core panel and to the groove, applying a loop fabric to the coated major surface of the core panel, wrapping the periphery of the fabric onto the edge and inserting the remaining periphery of the fabric into the groove along the entire extent of the groove.

The preferred embodiment of the present invention provides a method for firmly bonding a loop fabric to a foam core to form covered partition panels and for connecting such panels in any desired configuration by means of a hook tape. Permanence of the bond between the fabric and the core is enhanced by bonding the fabric into a groove along the continuous edge of the core such that a significant portion of the fabric-core interface on the edge of a panel between connected panels is not subject to perpendicular tension during use or disassembly.

The present invention also provides a method of connecting a plurality of partition wall panels in a desired configuration by means of a two-sided elongate hook fastener tape which allows assembly and disassembly without the use of any tools.

The groove-bonding technique described herein therefore allows a large number of assembly-disassembly cycles without deterioration of the fabric-core bond on the edge of a panel and makes it feasible to construct a partition wall from said fabric and core.

Partition wall panels described herein are connected to each other, at any desired point, by the use of hook fastener tape. All edges of the partition wall panels are inherently finished when constructed according to the present invention and finishing trim is not required to achieve a satisfactory appearance.

Thus it is an object of the present invention to provide an improved knock-down partition wall system comprised of a plurality of wall panels.

It is a further object of the present invention to provide a novel means for creating a durable fabric-core bond.

It is a further object of the present invention to provide a novel method for manufacturing rigid, lightweight, portable partition walls.

It is a further object of the present invention to provide a novel method for creating a fabric-covered panel having a fabric-core bond which allows the use of hook tape to fasten adjacent panels.

It is a further object of the present invention to provide a novel method for creating partition walls having a fabric-core bond which allows the walls to be assembled and disassembled without tools.

It is a further object of the present invention to provide partition wall panels which have finished edges and require no finishing trim and a novel method of manufacturing same.

It is a further object of the present invention to provide partition wall panels which have no unfinished surfaces or edges and can be used in any position and a novel method of manufacturing same.

Other objects, features and advantages of the present invention will become apparent upon reading the following specification, when taken in light of the drawing and the appended claims.

BRIEF DESCRIPTION OF THE DRAWING

FIG. 4 (B) is an exaggerated cross-sectional view of a partly completed wall panel.

FIG. 5 (B) is an exaggerated detail view of a typical loop fabric and a single-sided, adhesive-backed hook fastener tape.

FIG. 5 (C) is an exaggerated detail view of a typical loop-to-hook connection.

FIG. 5 (D) is an exaggerated detail view of typical hook deformation on disassembly.

FIG. 6 (B) is an exaggerated detail view of separation tension transmission through the loop fabric.

FIG. 6 (C) is an exaggerated detail view of the modification of separation tension transmission when a groove according to the invention is present.

FIG. 7 (B) is a cross-sectional view along line 7B—7B of FIG. 7 (A) of a panel with finishing trim.

FIG. 7 (C) is a cross-sectional view of the frame of finishing trim.

DETAILED DESCRIPTION

Figure 1:
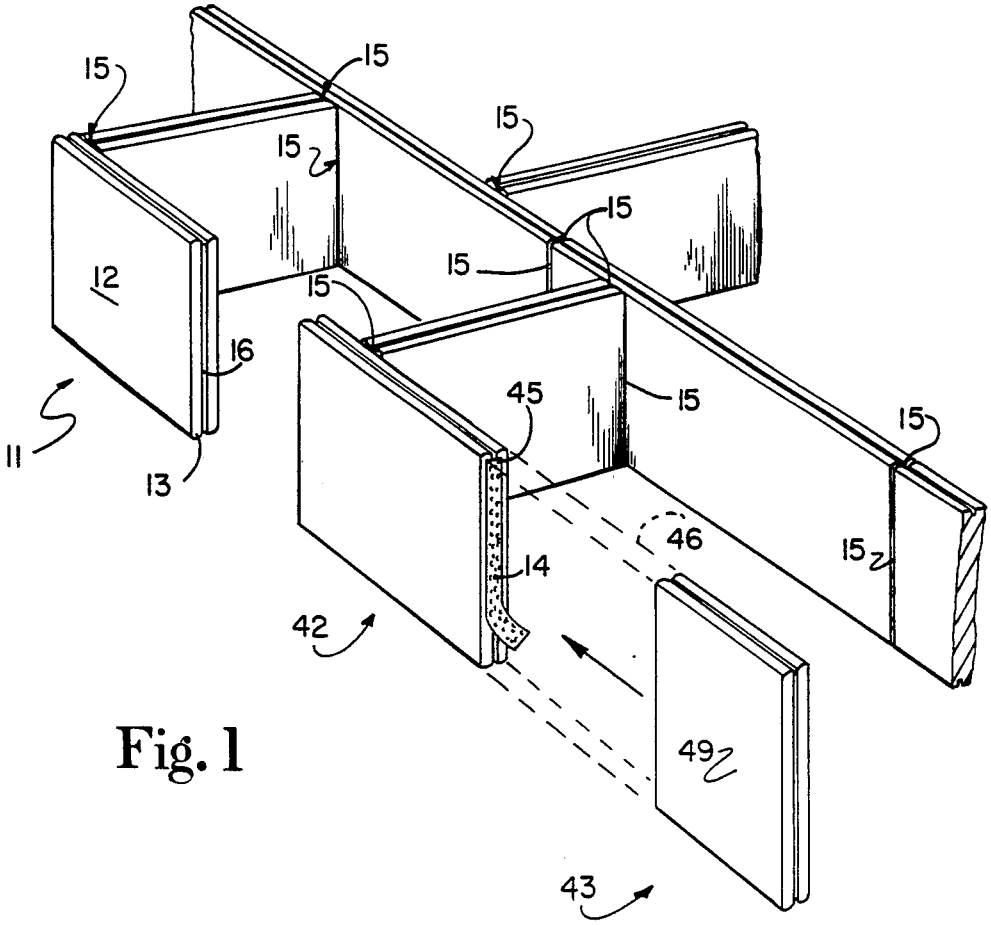
FIG. 1 is an illustration of a typical wall system embodying the present invention.

Turning now to the drawing, in which like numerals reference like parts throughout the several views, FIG. 1 illustrates an example of a typical wall system 10. Wall system 10 is comprised of a plurality of panels 11 connected together along their major surfaces 12 and/or edges 13 by means of an elongate hook fastener tape 14. A typical wall panel 11 is comprised of a core 20 which is completely covered by loop fabric 22 and is bound to the loop fabric 22 by a bonding agent 21.

In the preferred embodiment of the present invention, the core 20 is a two inch thick polystyrene board insulation, such as Styrofoam TM SM brand insulation manufactured by DOW CHEMICAL U.S.A., the loop fabric 22 is VELCRO TM velvet loop fabric manufactured by VELCRO USA, Inc., and the bonding agent 21 is VELCRO TM brand adhesive #90, manufactured by the Bostic Division of Emhart Corporation. The elongate hook fastener tape 14 is preferably VELCRO TM Hook 80 fastener tape, manufactured by VELCRO USA, Inc., under part number 1500-063-330-0199-BD. The preferred fabric 22 has a breathable jersey backing which allows the adhesive to set up quickly.

One skilled in the art will realize that other products may be substituted for the specific products listed above. For example, core 20 may be any lightweight, rigid material chemically compatible with the binding agent 21 utilized. The loop fabric 22 may be any loop fabric chemically compatible with binding agent 21 and having a size and number of loops per square inch which is compatible with elongate hook fastener tape 14. The binding agent 21 may be any adhesive which is chemically compatible with the core 20 and the loop fabric 22. The elongate hook fastener tape 14 may be any hook fastener tape which has hooks on both sides and which has a size and number of hooks per square inch which is compatible with the loop fabric 22.

Figure 2:
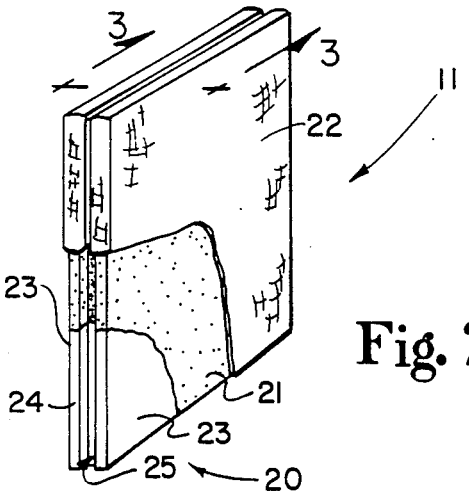
FIG. 2 is a cutaway view of a typical wall panel embodying the invention.

FIG. 2 is a cutaway view of a typical wall panel 11 and is comprised of four components, the core 20, which has two major surfaces 23 connected by a continuous edge 24 between the major surfaces 23, a groove 25 cut into the edge 24 continuously around the periphery of the core 20, the bonding agent 21 applied to the entirety of the major surfaces 23 and the groove 25, and the loop fabric 22 applied to the major surfaces 23, with its periphery wrapped around the edge 24, and inserted into the groove 25.

Figure 3:
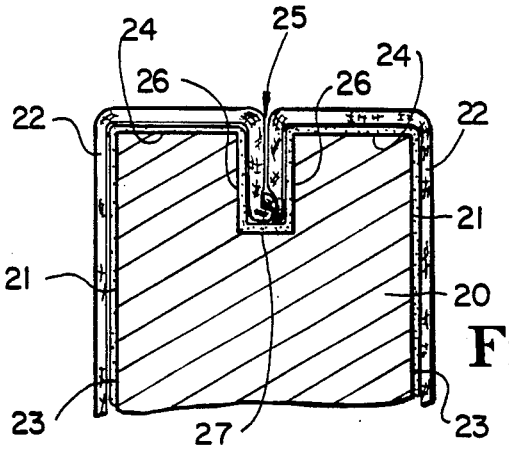
FIG. 3 is an exaggerated cross-sectional view of a groove taken along line 3—3 of FIG. 2.

FIG. 3 is an exaggerated detail view of the groove 25. The groove 25 is defined by parallel side surfaces 26 and a bottom surface 27. The loop fabric 22, after being wrapped around edge 24, is inserted into the groove 25 such that the loop fabric 22 is bound to the sides 26 and the bottom 27 of the groove 25 by the binding agent 21.

One skilled in the art will realize that the dimensions of the groove 25 may be varied. The depth of the groove 25 need only be enough to obtain a reasonable area for the fabric-core bond, but not so deep that the structural characteristics of the core 20 are compromised. The width of the groove 25 need only be enough to allow the loop fabric 22 to be inserted into the groove 25 but not so wide that a large gap appears between the pieces of the loop fabric 22 inserted into the groove 25.

Likewise, it will be apparent to one skilled in the art that the thickness of the core 20 is not critical, but need only be enough to allow the groove 25 to be cut into the core 20 without compromising the structural characteristics of the edges of the core 20.

In the preferred embodiment of the present invention, core 20 is two inches thick and groove 25 is ⅛ inch wide and 1.5 inches deep. One skilled in the art will also realize that dimensions of the loop fabric 22 are not critical, but need be only sufficiently larger than the dimensions of the major surface 23 of the core 20 to allow the loop fabric 22 to completely cover one of the major surfaces 23, edge 24, one side of 26 of groove 25 and a portion of the bottom 27 of groove 25, but not so much larger than the dimensions of major surface 23 of core 20 that there is too much of the loop fabric 22 to be completely inserted into the groove 25. In the preferred embodiment of the present invention, the dimensions of the loop fabric 22 exceed the dimensions of the major surface 23 of the core 20 by approximately six inches.

Figure 4A:
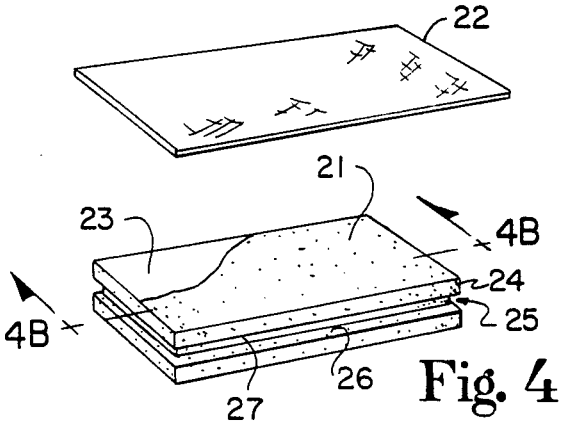
FIG. 4 (A) is an exploded view of a wall wall panel of the type shown in FIG. 2.
Figure 4B:
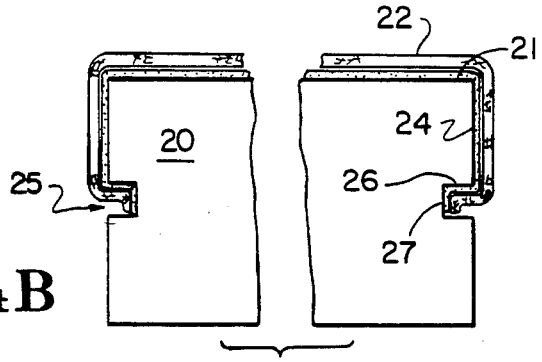

Referring to FIGS. 4(A) and 4(B), it will be seen that the panel 11 may be manufactured by employing the following steps. A groove 25, of appropriate dimensions, is cut into the edge 24 of a core 20 continuously around the periphery of the core 20. A binding agent 21 is then applied to the major surface 23, the edge 24, and to a side 26 and the bottom 27 of the groove 25. A sheet of loop fabric 22 is then applied to the coated major surface 23, wrapped around the coated edge 24, and inserted into the coated groove 25 such that the inserted part of the loop fabric 22 is in contact with the side 26 and the bottom 27 of the groove 25, which has also been previously coated with the binding agent 21. A sufficient amount of the sheet of the loop fabric 22 is inserted into the groove 25 to cause the loop fabric to be slightly stretched, or taut. The loop fabric 22 should be maintained in the stretched or taut condition until the binding agent 21 has set. The groove 25 itself assists in maintaining the taut condition of the fabric. It will be apparent to one skilled in the art that the loop fabric 22 is a material that stretches easily along its major dimensions and that it is therefore preferable to maintain the loop fabric 22 in a stretched, or taut, condition to prevent wrinkles from appearing in, or void areas, commonly called bubbles or blisters, from forming under the fabric 22 because of inadequate fabric-to-binding agent contact. The above steps are then repeated for the other major surface 23 of the core 20.

Referring again to FIGS. 1 and 2, it is seen that the finished panel 11 is completely covered by the loop fabric 22. Therefore, some of the major benefits to be obtained by use of the groove 25 are that all major surfaces 12 and edges 13 of panel 11 are inherently finished, all of the major surfaces 12 of panel 11 are identical, all the edges 13 of panel 11 are identical, and the uniform, finished appearance of the major surfaces 12 and edges 13 allows the wall panels 11 to be used in any desired orientation, with no preferred "up" or "down" orientation. The panel 11 therefore does not require finishing trim to be aesthetically pleasing.

Figure 5A:
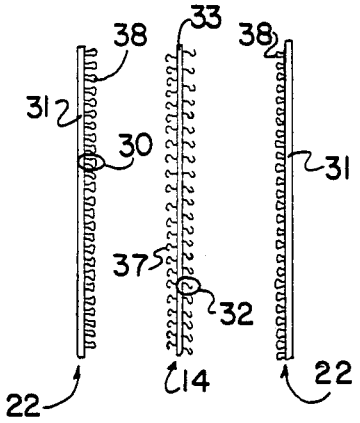
FIG. 5 (A) is an exaggerated detail view of a typical loop fabric and hook fastener tape.

Panels 11 constructed according to the invention can be joined together in various configurations as shown, for example, in FIG. 1, by using hook fastener tapes 14. FIG. 5(A) is an exaggerated detail view of the loop fabric 22 and the hook fastener tape 14. The loop fabric 22 includes two elements: a plurality of loops 30, and a backing 31 to which the loops 30 are attached. The hook fastener tape 14 also includes two elements: a plurality of hooks 32, and a backing 33 to which the hooks 32 are attached. A plurality of hooks 32 are attached to both sides of backing 33, so that two panels covered by the loop fabric 22 may be releasably joined together by means of the hook fastener tape 14.

Figure 5B:
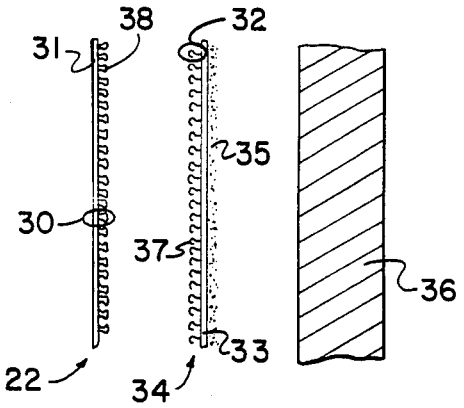

FIG. 5(B) is an exaggerated detail view of a typical loop fabric 22 and a single-sided, adhesive-backed hook fastener tape 34. The single-sided, adhesive-backed hook fastener tape 34 includes three elements: a plurality of hooks 32, a backing 33, both as previously mentioned, and an adhesive 35 for binding the single-sided, adhesive-backed hook fastener tape 34 to a surface 36, which preferably is not covered by the loop fabric 22. The single-sided, adhesive-backed hook fastener tape 34 is useful when releasably joining the panel 11 to a brick wall, dry wall, metal surfaces, signs and other objects or surfaces which are not covered with the loop fabric 22.

Figure 5C:
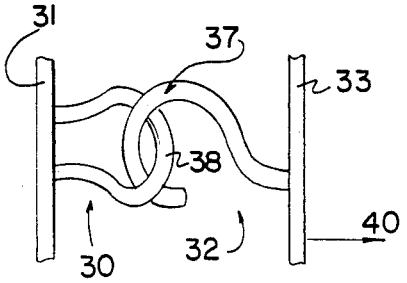

FIG. 5(C) is an exaggerated detail view of the connection between a loop 30 which includes a curved top 38, and a hook 32 which includes a curved end 37. The principle of operation of joining and releasing the loop fabric 22 to the hook fastener tape 14 is described below. When the loop fabric 22 and the hook fastener tape 14 are pressed together the curved end 37 of the hook 32 easily slides past the curved top 38 of the loop 30 and then engages the curved top 38 of loop 30.

Figure 5D:
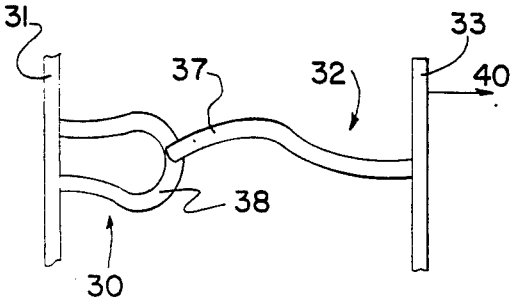

FIG. 5(D) is an exaggerated detail view of the deformation of the hook 32 on disassembly. To separate the loop fabric 22 from the hook fastener tape 14, once they are joined together, requires that a separation tension 40, in a direction indicated by an arrow, be applied which is sufficient to deform the curved end 37 of the hook 32 so that the loop 30 and the hook 32 can disengage. The hook 32 is made of a flexible material such that it will deform, but not break, when the separation tension 40 is applied, and will return to its original shape once the separation tension 40 is removed. It will be apparent to one skilled in the art that the separation tension 40 required to break a loop fabric-to-hook fastener tape connection is much larger than the force required to make the connection. Therefore, when objects having a surface of the loop fabric 22 are joined together by means of the hook fastener tape 14, the objects require a minimal force to be joined together, but require a substantially larger separation tension 40 to separate them. This method of joining panels 11 together thus provides a stable connection.

Figure 6A:
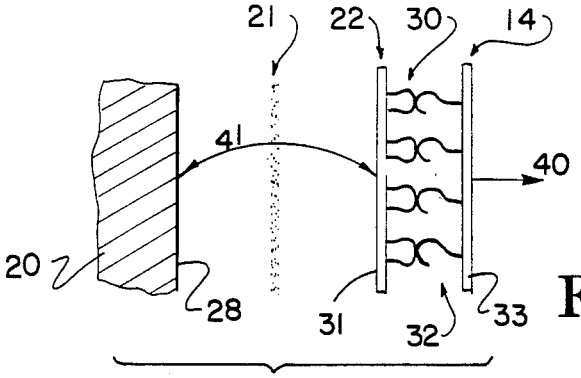
FIG. 6 (A) is an exaggerated, exploded detail view of the binding force and separation tension created when adjoining panels are separated.
Figure 6B:
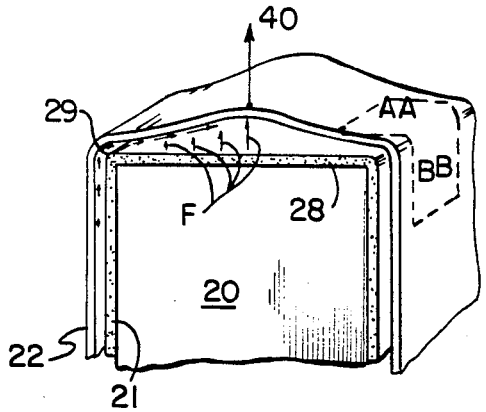

Another major benefit obtained by the use of the groove 25 will now be described with reference to FIG. 6(A), which shows an exaggerated detail view of a joint formed between two panels 11. As is well known to those skilled in the art, whenever a separation tension 40 is applied to a hook fastener tape 14, so as to break the connection between a loop fabric 22 and a hook fastener tape 14, there must be an equal and opposite binding force 41, between the loop fabric 22 and a core surface 28, which surface 28 may be either a major surface 23 or the edge 24 of the core 20. This binding force 41 is provided by the interposition of the binding agent 21 between the loop fabric 22 and the surface 28. It will be apparent to one skilled in the art that repeated assembly-disassembly operations will cause separation tension 40 to be repeatedly applied and will, over a period of time, tend to degrade the effectiveness of the binding agent 21, thereby allowing the loop fabric 22 to separate from the binding agent 21 or the surface 28. FIG. 6(B) is an exaggerated representation of the transmission of separation tension 40 through loop fabric 22 along a relatively wide surface 28 where the length of arrows is roughly representative of the magnitude and direction of the tension transmitted. The degradation of the effectiveness of the binding agent 21 occurs because most of separation tension 40 is applied perpendicular to the plane AA (shown in dotted lines) of the binding agent 21, with only a small fraction of the separation tension 40 being applied parallel to plane BB (also shown in dotted lines) by the action of the loop fabric 22 stretching and transmitting a small fraction of the separation tension 40 around the edge 24 to the major surface 23. It is well known to those skilled in the art that the fraction of the separation tension 40 conducted by the stretching of the loop fabric 22 is roughly inversely proportional to the distance between the point of application of the separation tension 40 and the corner 29 of the core 20 formed at the intersection of the edge 24 and the major surface 23.

Figure 6C:
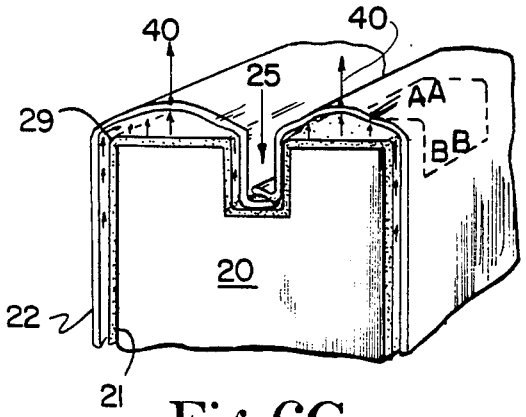

FIG. 6(C) shows the modified transmission of the separation tension 40 through the loop fabric 22 when the groove 25 is present. When the groove 25 is implemented, a substantially larger portion of the separation tension 40 is applied parallel to plane BB because the loop fabric 22 need not stretch as far before part of the separation tension 40 is conducted around the corner 29 and onto the major surface 23. Since less tension is applied to plane AA of the binding agent 21 on each disassembly operation, a much larger number of assembly-disassembly operations can be conducted before there is any substantial degradation in the effectiveness of the binding agent 21.

Referring again to FIG. 1, when it is desired to join panels marked 42 and 43, to form a junction 15, the hook fastener tape 14 is applied by hand and pressed onto an edge 45 of the panel 42 so that the edge 45 locks into the hook fastener tape 14 in the manner described above. Then the panel 43 is moved so that an edge 46 of the panel 43 is pressed onto the tape 14. Panels 42 and 43 are thereby releasably joined together at edges 45 and 46 by the hook fastener tape 14. It will be apparent to one skilled in the art that the wall system 10 allows the panels 42 and 43 to be releasably joined together at other points as well, e.g.—major surface 48 to edge 46, major surface 48 to major surface 49, or edge 45 to major surface 49. The wall system 10 can therefore be assembled using a plurality of panels 11 and hook fastener tapes 14, without using any tools, to achieve any desired configuration.

It will also be seen from FIG. 1 that the hook fastener tape 14 is narrower than the edges 45 or 46 of the panels 42 or 43. Therefore, if the hook fastener tape 14 is black or a darker shade of the color of the loop fabric 22, then the hook fastener tape 14 will blend into the dark line at a junction 15 of adjoining panels 11. It will be apparent that there are no open gaps between adjoining panels 11 because the hook fastener tape 14 completely fills the space between adjoining panels 11 at the junction 15 of the panels 11.

Figure 7A:
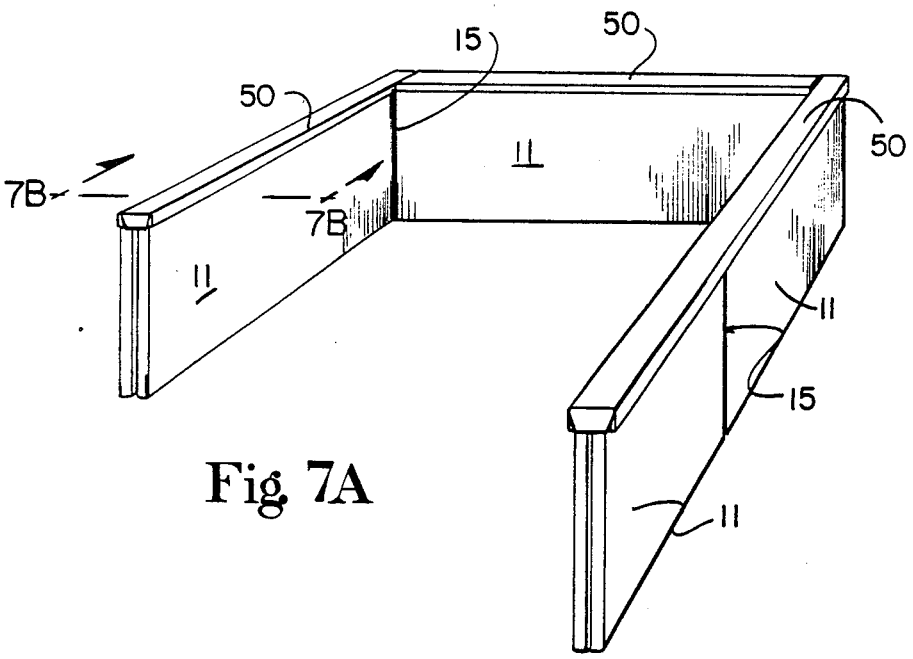
FIG. 7 (A) is an illustration of a typical wall system with finishing trim.
Figure 7B:
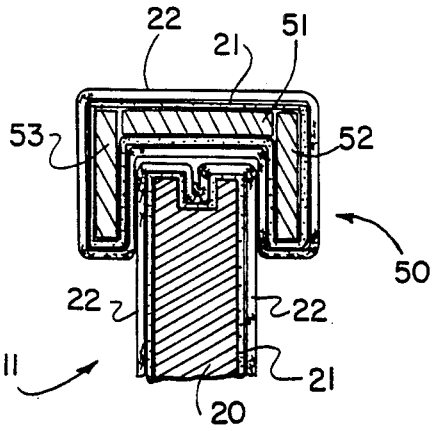
Figure 7C:
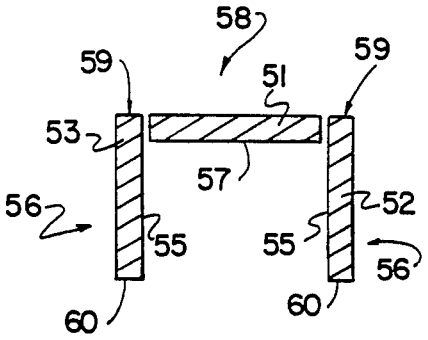

Although it is apparent from FIG. 1 that finishing trim is not required to achieve a satisfactory wall system 10, finishing trim can be made and applied. FIG. 7(A) is an illustration of several assembled wall panels 11 with finishing trim 50. FIG. 7(B) is a cross-sectional view of one of the wall panels 11 with finishing trim 50 installed. Finishing trim 50 is comprised of boards 51, 52, and 53 which form an inverse "U"-shaped frame 54 which fits snugly over the edge 13 of a panel 11. A loop fabric 22 is bound to boards 51, 52 and 53 by a binding agent 21. In the preferred embodiment of the present invention, the loop fabric 22 and the binding agent 21 are as previously described and specified. For use with a two-inch thick core, the boards 51, 52 and 53 may be $\frac{3}{4}''\times 2\ 5/16''$, with the boards 51, 52 and 53 having a length necessary to cover the desired number of panels 11.

The frame 54 is assembled so that boards 52 and 53 form the legs of an inverted U and board 51, which preferably is between, and not on top of, boards 52 and 53, forms the top of the inverted U. Board 51 has a top surface 58 and an inner surface 57. Boards 52 and 53 have outer surfaces 56, inner surfaces 55, upper edges 59, and lower edges 60. In the preferred embodiment of the present invention, the boards 51, 52 and 53 are joined together by finishing nails, but may be joined together by other types and/or sizes of nails or glue or other adhesives. All surfaces of the frame 54 are then completely coated with the binding agent 21. The loop fabric 22 is then stretched taut, placed over the top surface 58 of board 51 and the upper edges 59 of boards 52 and 53, wrapped around the outside surfaces 56 and boards 52 and 53, wrapped around the lower edges 60 of boards 52 and 53, pressed against the inner surfaces 55 of boards 52 and 53, and pressed against the inner surface 57 of board 51, all while maintaining the loop fabric 22 in a taut condition. The loop fabric 22 is held in this position until the binding agent 21 has set. The loop fabric 22 may also be stapled to the inner surface 57 instead of holding the loop fabric 22 until the binding agent 21 has set. One skilled in the art will realize that a notch must be cut into the board 52 or 53 at an appropriate place whenever the panels 11 are joined together at right angles to permit the intersecting panels to contact the panel carrying the finishing trim.

Figure 8:
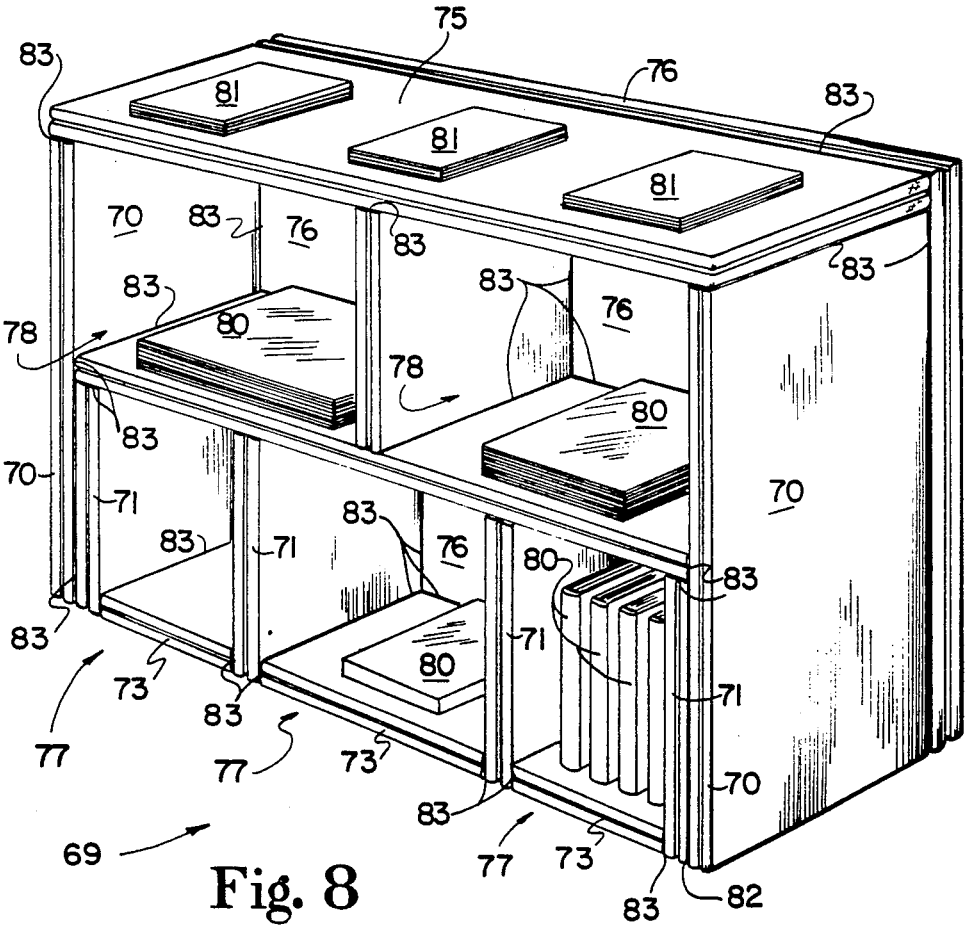
FIG. 8 is an illustration of a typical display counter or shelf constructed according to the invention.

FIG. 8 is an illustration of a typical display counter assembled from panels embodying the present invention. Grooves 25 are omitted from FIG. 8 for clarity. It will be seen that, by the use of a number of suitable sized smaller panels, lightweight shelves and display counters can be quickly and easily assembled for supporting both light and heavy articles. Adequate strength and rigidity for supporting heavier articles can be achieved by the use of several vertical support panels.

The display counter 69 is a rectangular parallelpiped which is closed and bounded on five sides and is open on a sixth side which faces an observer. The display counter 69 includes five rectangular parallelpiped compartments, three of which are a small compartment 77 and two of which are a larger compartment 78, the larger compartments 78 being directly above the smaller compartments 77. The display counter 69 is comprised of a plurality of panels 70, 71, 72, 76 and shelves 73, 74 and 75, all of which are constructed identically to the panels 11 previously described, and all of which are appropriately connected at the junctions 82 and 83 by hook fastener tape 14. Objects shown resting on various shelves of the display counter 69 are lighter objects 81, and lighter or heavier objects 80.

The smaller compartments 77 are closed and bounded on the left side, the right side, the top, the bottom and the back, and are open on the front, which faces the viewer. Two minor panels 71 form the sides and are separated by a bottom shelf 73, which forms the bottom. The side edges of the bottom shelf 73 are connected at junctions 83 to the extreme lower part of the major surface of the minor panels 71. In FIG. 8, the junctions 83 represent junctions between the edge of one panel 11 and a part of the major surface of another panel 11, the panels 11 being joined together by hook fastener tape 14. Adjoining small compartments 77 share a common minor panel 71 as a common side. Middle shelf 74 forms the top of the smaller compartment 77. The top edges of minor panels 71 are connected at the junctions 83 to the lower major surface of the middle shelf 74. The middle shelf 74 is sufficiently large so that a single middle shelf 74 forms the top for the three smaller compartments 77. One skilled in the art will realize that the minor panels 71, besides defining the smaller compartments 77, also provide support for the middle shelf 74 and a top shelf 75.

The display counter 69 also includes a back panel 76. The front surface of back panel 76 faces the viewer and is connected at the junctions 83 to the back edges of the minor panels 71, the bottom shelves 73, and the middle shelf 74. The back panel 76 extends upwardly to the top shelf 75 and forms the back for the three smaller compartments 77 and the two larger compartments 78. It will be obvious to one skilled in the art that the back panel 76 also provides lateral stability to the display counter 69.

The larger compartments 78 are closed and bounded on the left side, the right side, the top, the bottom, and the back and are open on the front, which faces the viewer. The upper portion of a side panel 70 forms one side of the larger compartments 78, and a divider panel 72 forms the other side. The lower portion of the side panels 70 is parallel to and connected at a junction 82 to the outer major surfaces of the two outermost minor panels 71. The junction 82 is the junction between the major surface of one panel 11 and the major surface of another panel 11, the panels 11 being joined together by a number of strips of the hook fastener tape 14 (not shown) sufficient to achieve a desired stability when objects 80 and 81 are placed in and/or on the display counter 69. The middle shelf 74 forms the bottom of the larger compartments 78 and is sufficiently large so that a single middle shelf 74 forms the bottom of both larger compartments 78. The middle shelf 74, as previously stated, also forms the top for the three smaller compartments 77. The side edges of the middle shelf 74 are connected at junctions 83 to the inner major surface of the two side panels 70 at a point immediately above the top edge of the outermost minor panels 71. The bottom edge of the divider panel 72 is connected at a junction 83 to the top major surface of middle shelf 74 at a point approximately midway between the left and right edges of the middle shelf 74.

The larger compartments 78 share the common divider panel 72 as a common side. A top shelf 75 forms the top of the larger compartments 78. The top edges of side panels 70 and the divider panel 72 are connected at the junctions 83 to the bottom major surface of the top shelf 75. One skilled in the art will realize that the divider panel 72, besides defining the larger compartments 78, also provides support for the top shelf 75.

The front major surface of the back panel 76 faces the viewer and is connected at the junctions 83 to the back edges of the side panels 70, the divider panel 72, and the top shelf 75. As previously stated, a single back panel 76 is sufficiently large so that it forms the back for the three smaller compartments 77 an the two larger compartments 78.

It will be apparent to one skilled in the art that even heavier objects 80 and 81 may be placed in and/or upon the display counter 69 if multiple parallel panels such as at 70, 71, connected at a junction 82, are used instead of the single panels used for the side panels 70, the minor panels 71, the divider panel 72, the middle shelf 74 and the top shelf 75.

It will also be apparent to one skilled in the art that any number of compartments 77 and 78 may be used, that compartments 77 and 78 may be any size desired, and that compartments 77 and 78 may be subdivided into other smaller compartments.

One skilled in the art will also realize that the back panel 76 may be a panel 11 also used as a wall in a partition wall system 10. The back panel 76 may also be a common back panel for two display counters 69 facing in opposite directions. The back panel 76 may also be the side panel 70 of another display counter 69 which is facing in an orthagonal direction.

If the panels 11 are intended to be used in an application where the panels 11 will be repeatedly bumped by personnel or machinery the light weight of the panels 11 may be thought to be an inconvenience since repeated bumping may cause the entire wall system 10 or display counter 69 to slide along the floor. However, this inconvenience may be easily overcome by adding more weight to the wall system. This weight could be easily and conveniently added by the use of, for example, the finishing trim 50, or formica-covered particle board for the shelves 74 and 75. Weight may also be added indirectly, without actually increasing the weight of the wall system 10 or the display counter 69, by releasably joining an object having substantial weight, such as a desk or wall, to the panels 11. The panels 11 are easily joined to other heavier objects by the single-sided, adhesive-backed hook fastener tape 34. Sufficient additional weight may also be provided, in some applications, by the presence of objects 80 and 81 in and/or on the display counter 69.

From the foregoing, it will be understood by those skilled in the art that the present invention provides significant improvements and advantages over prior methods and apparatus for manufacturing and/or utilizing partition wall panels. An apparatus embodying the present invention does not merely substitute more modern materials for the panels, but provides a new method for manufacturing and/or utilizing the panels. Thus, the present invention results in a substantially lighter weight panel which can be assembled, disassembled and re-used without the use of tools. Flexibility is provided in that the panels are finished on all surfaces, require no finishing trim, and may be used in any desired orientation. Furthermore, the covering fabric resists staining and discoloration and thereby increases the useful lifetime of the panel.

In addition, the panels may be easily configured to provide other decorative or functional forms, such as box beams, which would provide a strong structural member. It is also readily apparent that the panels need not be joined solely to other, like panels, but may be joined, by the use of single-sided, adhesive-backed hook fastener tape, to other, dissimilar panels which may have been previously installed.

If, in a given application, it is impractical, because of size and space limitations, to use a plurality of the panels 11 to support a particularly heavy object, the object could be supported, for example, by commercially available shelves which are connected to and supported by slotted vertical channels. Each vertical channel could then be incorporated between two panels 11 by pressing the adhesive side of single-sided adhesive-backed hook fastener tape 34 to the sides of the vertical channel and then pressing the edge 13 or the major surface 12 of the panel 11 against the hook side of the tape 34. Alternatively, a slotted square or rectangular vertical tube could be used instead of a vertical channel, in which case the tape 34 could be attached to the sides and/or back of the vertical tube. A panel 11 between the slotted members would thus form a back panel for the shelves. This panel-to-vertical channel/tube connection therefore allows for the support and display of particularly heavy objects without detracting from the overall decorum achieved by using the panels 11.

While the invention has been described in detail with particular reference to preferred embodiments thereof, it will be understood that variations and modifications can be effected within the spirit and scope of the the invention as described hereinbefore and as defined in the appended claims.

I claim:

1. A knock-down wall system for joining a panel to a static member, comprising:

a panel comprising:

a core comprising a pair of major surfaces connected by an edge surface, said edge surface defining a groove therein;

an adhesive binding agent applied to said major surfaces and to said groove; and loop fabric applied to both said major surfaces and extending from both said major surfaces into said groove, said fabric being adhered to said major surfaces and to said groove by said adhesive binding agent; and hook fastener tape extending substantially the same length as the length of said groove, said tape being attached to said static member;

said grooved edge surface of said panel being removably joined to said static member solely along said hook fastener tape by interconnection of said hook fastener tape with said loop fabric on both sides of said groove.

2. The system of claim 1, wherein said panel comprises a synthetic resinous foam board, said groove being defined in said foam board.

3. The system of claim 2, wherein said foam board comprises polystyrene.

4. The system of claim 1, wherein said groove has a width such that said fabric and adhesive substantially fill said groove.

5. The system of claim 1, wherein said hook fastener tape is double-sided and wherein said static includes loop fabric attached to one side of said hook fastener tape.

6. The systems of claim 1, wherein said fabric includes a breathable jersey backing.

7. A method of joining a panel to a static member to make a knock-down wall system, comprising the steps of:

forming a core so as to define a pair of major surfaces connected by an edge surface, and a groove in said edge surface;

applying an adhesive binding agent to said major surfaces and to said groove;

applying a loop fabric to both said major surfaces and extending said loop fabric from both said major surfaces into said groove, said fabric being adhered to said major surfaces and to said groove by said adhesive binding agent;

attaching hook fastener tape extending substantially the same length as the length of said groove to said static member; and joining said grooved edge surface to said static member solely along said hook fastener tape by interconnection of said hook fastener tape with said loop fabric on both sides of said groove.

* * * * *